US008944557B1

(12) United States Patent
Takayama et al.

(10) Patent No.: US 8,944,557 B1
(45) Date of Patent: Feb. 3, 2015

(54) RECORDING APPARATUS AND CONTROL METHOD OF RECORDING APPARATUS HAVING A CONVEYANCE ROLLER PAIR UPSTREAM OF A RECORDING UNIT

(71) Applicant: Canon Kabushiki Kaisha, Tokyo (JP)

(72) Inventors: Yuji Takayama, Kawasaki (JP); Keisei Hakamata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/331,769

(22) Filed: Jul. 15, 2014

(30) Foreign Application Priority Data

Jul. 19, 2013 (JP) ..... 2013-150362

(51) Int. Cl.
*B41J 13/00* (2006.01)

(52) U.S. Cl.
CPC ..... *B41J 13/0009* (2013.01)
USPC ..... 347/16; 347/101

(58) Field of Classification Search
CPC .. B41J 13/0009; B41J 11/007; B41J 11/0095; B41J 13/103; B41J 15/04; G06K 15/16
USPC ..... 347/14, 16, 19, 101, 104, 105, 116
See application file for complete search history.

(56) References Cited

U.S. PATENT DOCUMENTS

| | | | | |
|---|---|---|---|---|
| 5,488,407 | A | 1/1996 | Tachibana | |
| 7,883,169 | B2 * | 2/2011 | Yasue et al. | 347/16 |
| 2011/0242180 | A1 * | 10/2011 | Yamamoto | 347/16 |

FOREIGN PATENT DOCUMENTS

| | | | |
|---|---|---|---|
| JP | 63-27278 | A | 2/1988 |
| JP | 4-115980 | A | 4/1992 |

* cited by examiner

*Primary Examiner* — Thinh Nguyen
(74) *Attorney, Agent, or Firm* — Canon USA, Inc., IP Division

(57) ABSTRACT

A recording apparatus includes conveyance roller pair disposed on the upstream side of a recording unit. An image formation operation is forbidden once the trailing edge of a recording medium has passed the conveyance roller pair, to reduce margin amount at the trailing edge of the recording medium. In a case where determination is made that the distance from the trailing edge of the recording medium to the conveyance roller pair is smaller than a first conveyance amount, the recording medium is conveyed by a second conveyance amount which is smaller than the first conveyance amount, so that the trailing edge of the recording medium is on the upstream side of the conveyance roller pair and that the distance from the trailing edge of the recording medium to the conveyance roller pair is smaller than a predetermined distance.

10 Claims, 10 Drawing Sheets

RECORDING APPARATUS AND CONTROL METHOD OF RECORDING APPARATUS HAVING A CONVEYANCE ROLLER PAIR UPSTREAM OF A RECORDING UNIT

BACKGROUND OF THE INVENTION

1. Field of the Invention

The present invention relates to a recording apparatus and to a control method of the recording apparatus.

2. Description of the Related Art

U.S. Pat. No. 5,488,407 describes an image recording apparatus which includes a recording head which records on recording paper, a conveyance roller pair disposed upstream from the recording head in the conveyance direction of the recording paper, and a discharging roller pair disposed downstream from the recording head. After the trailing edge of the recording paper has exited the conveyance roller pair, the recording paper is conveyed by the discharging roller pair alone. The conveyance accuracy of the discharging roller pair is lower than that of the conveyance roller pair. Accordingly, image quality is lower in cases where the recording paper is conveyed by the discharging roller pair.

U.S. Pat. No. 5,488,407 describes an arrangement where, upon the trailing edge of the recording paper being detected, determination is made regarding whether or not all image data can be recorded in the recording area of that sheet of recording paper. If determination is made that not all image data can be recorded in the recording area, the recording operation onto that sheet of recording paper is cancelled, and a page brake is performed.

In a case where determination is made in U.S. Pat. No. 5,488,407 that not all image data can be recorded in the recording area when detecting the trailing edge of the recording medium, no recording is performed thereafter on that sheet of recording medium after detection of the trailing edge, in a region between a position where recording was last performed and the trailing edge of the sheet, though the recording medium is conveyed past the recording position. Accordingly, there has been a problem of great margin amounts toward the trailing edge of the sheets of recording medium.

SUMMARY OF THE INVENTION

A recording apparatus is provided which has a conveyance roller pair upstream of a recording unit, and in which image formation operations are forbidden after the trailing edge of a recording medium exits the conveyance roller pair, where margin amount toward the trailing edge of the recording medium can be reduced.

A recording apparatus according to the present invention includes: a recording unit configured to record onto a recording medium; a conveyance roller pair disposed on the upstream side of the recording unit in a conveyance direction of the recording medium; a detecting unit configured to detect a trailing edge of the recording medium; and a control unit configured to perform recording on the recording medium by repeatedly performing a conveying operation of the conveyance roller pair conveying the recording medium by a first conveyance amount and an image formation operation of the recording unit forming an image on the recording medium, where the image formation operation is forbidden by the control unit once the trailing edge of the recording medium has passed the conveyance roller pair. In a case where determination is made by the detecting unit that a distance from the trailing edge of the recording medium to the conveyance roller pair is smaller than the first conveyance amount, the control unit effects control such that the conveyance roller pair conveys the recording medium by a second conveyance amount which is smaller than the first conveyance amount, so that the trailing edge of the recording medium is on the upstream side of the conveyance roller pair in the conveyance direction and that the distance from the trailing edge of the recording medium to the conveyance roller pair is smaller than a predetermined distance.

Further features of the present invention will become apparent from the following description of exemplary embodiments with reference to the attached drawings.

DESCRIPTION OF THE EMBODIMENTS

Embodiments of the present invention will be described with reference to the drawings.

First Embodiment

Figure 1:
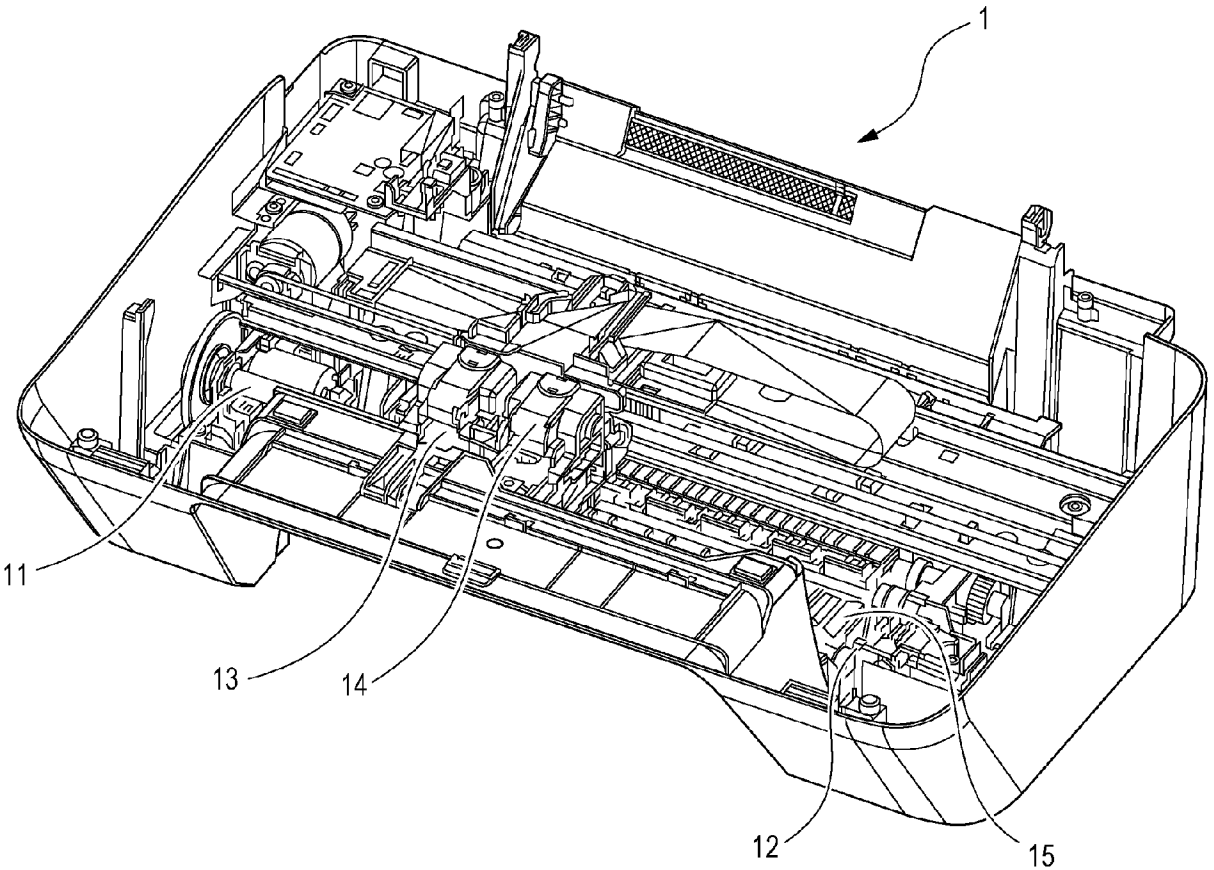
FIG. 1 is a perspective view illustrating the internal configuration of a recording apparatus according to an embodiment of the present invention.

FIG. 1 is a perspective view illustrating the internal configuration of a recording apparatus 1. A recording head 13 forms images by discharging ink onto a recording medium P. A carriage 14 is mounted with the recording head 13 and moves in a main scanning direction. The recording head 13 mounted on the carriage 14 performs image forming operations while the carriage 14 is moving in the main scanning direction.

A platen 15 supports the recording medium P at a position facing the recording head 13. A conveyance roller 11 is disposed upstream from the recording head 13 in the conveyance direction of the recording medium P. A discharging roller 12 is disposed downstream from the recording head 13 in the conveyance direction of the recording medium P.

The conveyance roller 11 and discharging roller 12 perform conveyance operations, to convey the recording medium P, fed from a stacking portion 20 by a later-described feeding roller 21, in a sub-scanning direction. The sub-scanning direction is a direction orthogonal to the main scanning direction in which the carriage 14 moves.

The recording apparatus 1 forms images on the recording medium P by repeating the conveying operations by the conveyance roller 11 and the discharging roller 12, and the image formation operation by the recording head 13 mounted on the carriage 14 moving in the main scanning direction. In the conveying operations, the conveyance roller 11 and discharging roller 12 convey the recording medium P by a predetermined conveyance amount (first conveyance amount).

Figure 2:
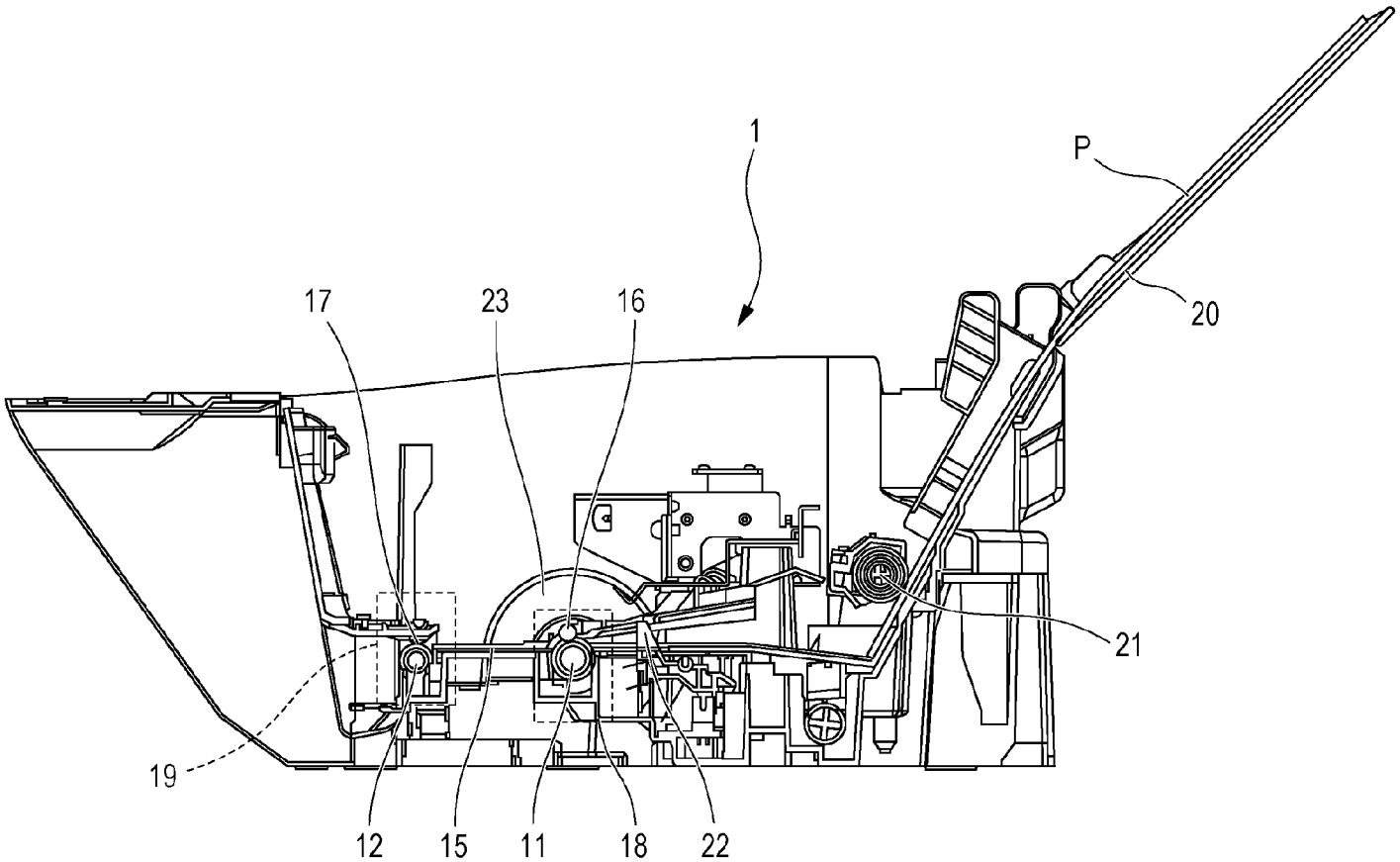
FIG. 2 is a cross-sectional view illustrating the internal configuration of the recording apparatus.

FIG. 2 illustrates a cross-sectional view of the internal configuration of the recording apparatus 1. The feeding roller 21 picks up the recording medium P stacked on the stacking portion 20. The recording medium P picked up by the feeding roller 21 is fed toward the conveyance roller 11.

A conveyance pinch roller 16 follows the rotations of the conveyance roller 11, and in cooperation with the conveyance roller 11 nips the recording medium P conveyed by the conveyance roller 11. A discharging pinch roller 17 follows the rotations of the discharging roller 12, and in cooperation with the discharging roller 12 nips the recording medium P conveyed by the discharging roller 12. The recording medium P is conveyed being nipped by a conveyance roller pair 18 including the conveyance roller 11 and conveyance pinch roller 16. The discharging roller 12 and discharging pinch roller 17 make up of discharging roller pair 19 so as to nip the recording medium P.

The conveyance roller 11 and discharging roller 12 are driven by the same conveyance motor, which is omitted from illustration. When the conveyance motor is rotated by a unit amount, the distance of movement on the circumference of the discharging roller 12 is greater than the distance of movement on the circumference of the conveyance roller 11. This is to prevent the recording medium P from sagging while being conveyed by the conveyance and discharging rollers. Accordingly, when the conveyance motor is rotated by a predetermined amount, the conveyance amount of the discharging roller 12 when performing conveyance operations alone may be greater than the conveyance amount when the conveyance roller 11 and discharging roller 12 are both performing conveyance operations. Also, the force of the conveyance roller pair 18 holding the recording medium P is greater than the force of the discharging roller pair 19 holding the recording medium P. Accordingly, when the recording medium P is being held by both roller pairs, the conveyance roller pair 18 becomes dominant. In this case, there may be a region in the image on the recording medium P where nothing is recorded when the trailing edge of the recording medium P exits the conveyance roller pair 18 and the recording medium P is conveyed by the discharging roller pair 19 alone. That is to say, white streaks may occur in the image on the recording medium P. Accordingly, no image formation operations are performed on the recording medium P once the trailing edge of the recording medium P has passed the conveyance roller pair 18.

A code wheel 23 is disposed on the shaft of the conveyance roller 11, and is used to detect conveyance amount of the recording medium P by the conveyance roller 11. An encoder sensor, omitted from illustration, reads the rotations of the code wheel 23, and thus detects the rotational amount of the conveyance roller 11, which is the amount of conveyance of the recording medium P by the conveyance roller 11. The encoder sensor is attached adjacent to the code wheel 23.

A paper end sensor 22 detects whether or not the leading edge and trailing edge of the recording medium P have passed. The leading edge of the recording medium P is detected by the paper end sensor 22 after having been fed by the feeding roller 21. The trailing edge of the recording medium P is detected by the paper end sensor 22 while being conveyed by the conveyance roller 11.

Figure 3:
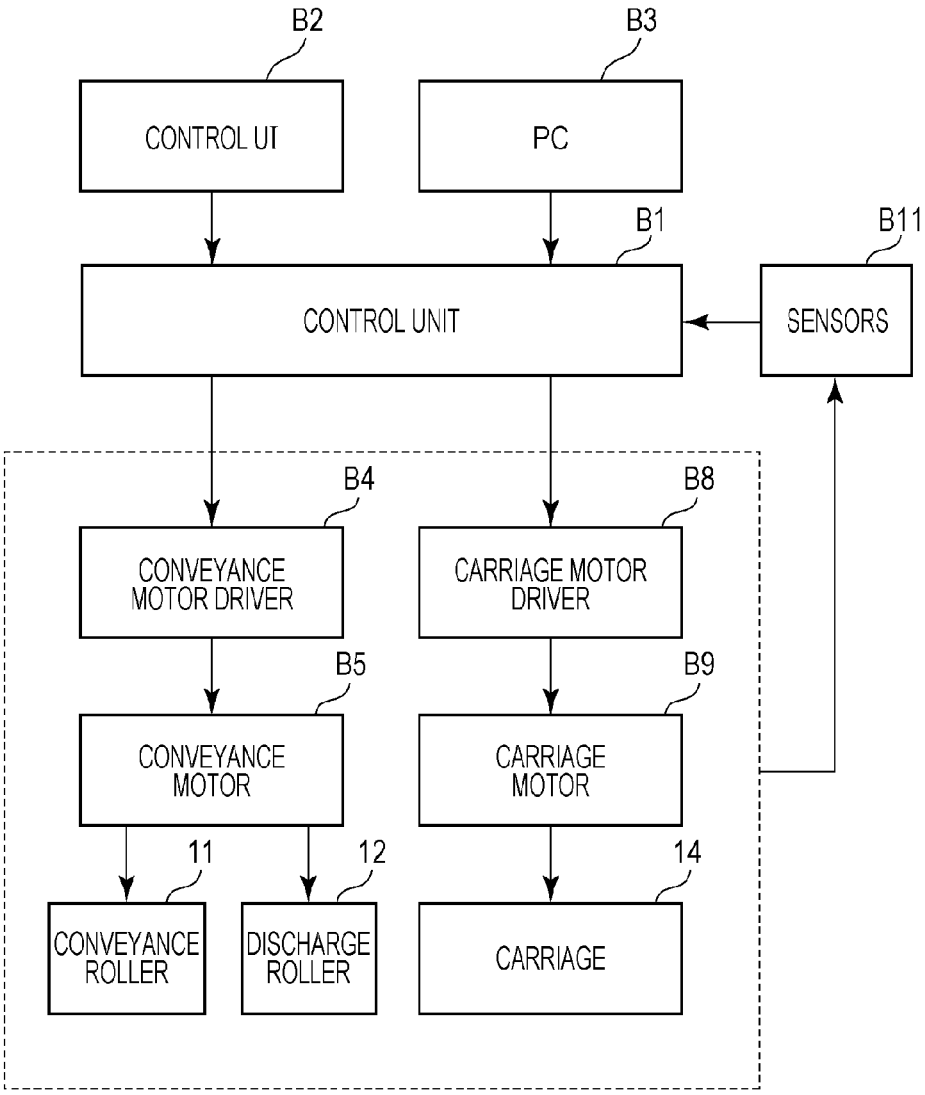
FIG. 3 is a block diagram illustrating the configuration of a control circuit of the recording apparatus.

FIG. 3 illustrating a block diagram of the configuration of a control circuit of the recording apparatus 1. A control unit B1 is input with recording operation commands from an operation user interface B2 provided to the printing apparatus 1 or a personal computer (PC) B3.

The control unit B1 drives a conveyance motor B5 in accordance with a recording operation command, by way of a conveyance motor driver B4. The conveyance roller 11 and discharging roller 12 are driven by the conveyance motor B5 via a drive transmission system. Accordingly, the conveyance roller 11 and discharging roller 12 rotate following driving of the conveyance motor B5. The conveyance roller 11 and discharging roller 12 rotate synchronously to convey the recording medium P.

The control unit B1 drives a carriage motor B9 in accordance with a recording operation command, by way of a carriage motor driver B8. The carriage 14 is driven by the carriage motor B9 via the drive transmission system. Accordingly, the carriage 14 moves in the main scanning direction following the driving of the carriage motor B9. The recording head 13 mounted on the carriage 14 discharges ink in accordance with driving commands received from the control unit B1, thereby performing image formation operations and so forth.

Sensors B11 include the encoder sensor of the conveyance roller 11 described with FIG. 2, the paper end sensor 22, and so forth. The sensors B11 are provided at various locations within the recording apparatus 1. The rotational states of the motors, such as the conveyance motor B5 and the carriage motor B9, are determined based on information from the sensors B11. Information relating to the rotational states of the motors that has been detected is transmitted to the control unit B1.

Detection results of the leading edge and trailing edge of the recording medium P, detected by the paper end sensor 22, is transmitted to the control unit B1 in the form of signals. The control unit B1 performs position management of the recording medium P in the conveyance direction, based on the detection results of the leading edge and trailing edge of the recording medium P, and the information relating to the rotational state of the motors.

Figure 4:
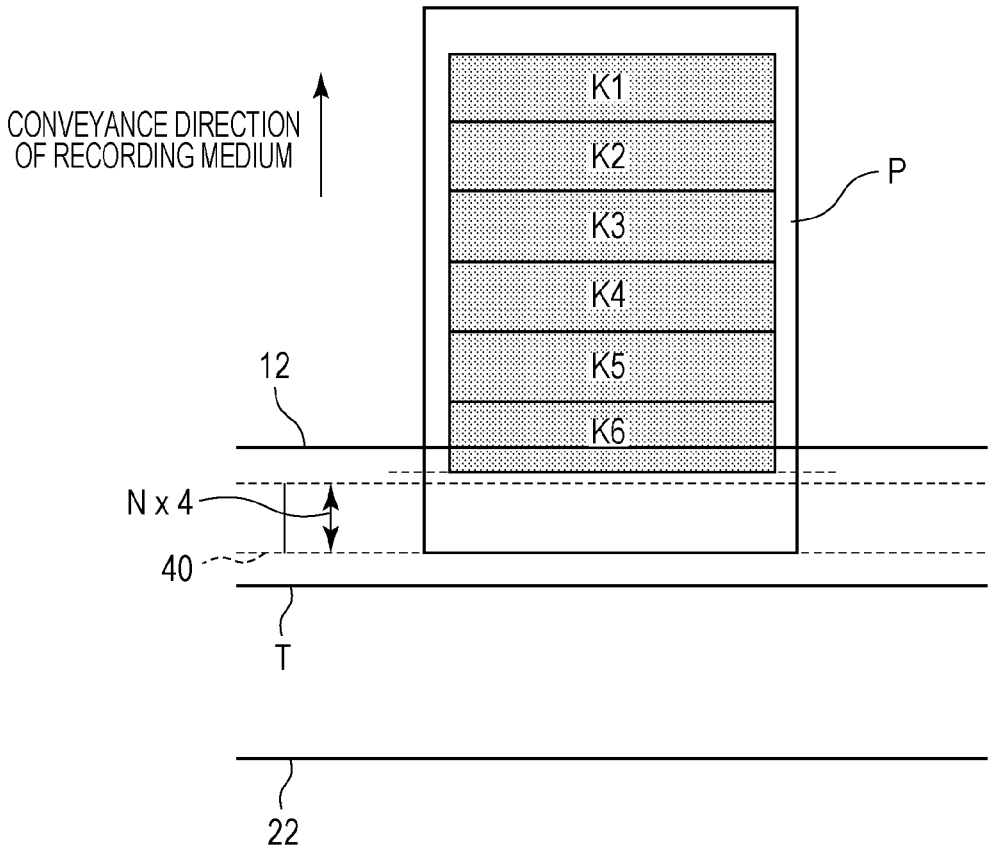
FIG. 4 is a diagram illustrating the positional relation between the recording apparatus and a recorded image.

FIG. 4 illustrates the positional relation between the conveyance roller pair 18 and a recorded image recorded on the recording medium P. FIG. 4 shows the recording medium P as viewed from the recording head 13 side. A position T is the nip position of the conveyance roller pair 18. In the following description, the trailing edge of the recording medium P exiting the conveyance roller pair 18 will be described as the trailing edge of the recording medium P passing the nip position T. The position of the nip position T is to be understood as a region having length in the conveyance direction of the recording medium, which changes due to variation in dimensions of parts such as the conveyance roller 11 and thickness of the recording medium P.

One scan of the carriage 14 performs an image formation operation by the recording head 13 mounted on the carriage 14. This one scan forms an image having a width in the main scanning direction equivalent to the length of a discharge orifice array 40 in the main scanning direction. The discharge orifice array 40 has multiple orifices which discharge ink arrayed in the conveyance direction of the recording medium P. There are some recording apparatus which perform multi-pass recording, where an image is formed by performing main scans multiple times over the same region in the image formation operation. However, the present embodiment is described as performing one-pass recording, where an image is formed by performing one main scan over the same region. After this image formation operation, a conveyance operation is performed in which the recording medium P is conveyed by a conveyance amount L1. The conveyance amount L1 is equivalent to the length of the discharge orifice array 40 in the conveying direction of the recording medium P. After the conveyance operation, an image formation operation is performed again. K1 through K6 are images formed by the first through sixth main scans of the image formation operations. The length of each of the images K1 through K6 in the conveyance direction is the same as the length of the discharge orifice array 40.

A conveyance operation of a conveyance amount L1 is performed after the image formation operation to form the image K6, whereby the trailing edge of the recording medium P passes the nip position T. Accordingly, no image formation operation is performed as to the recording medium P downstream of the image K6 in the conveyance direction.

Figure 5:
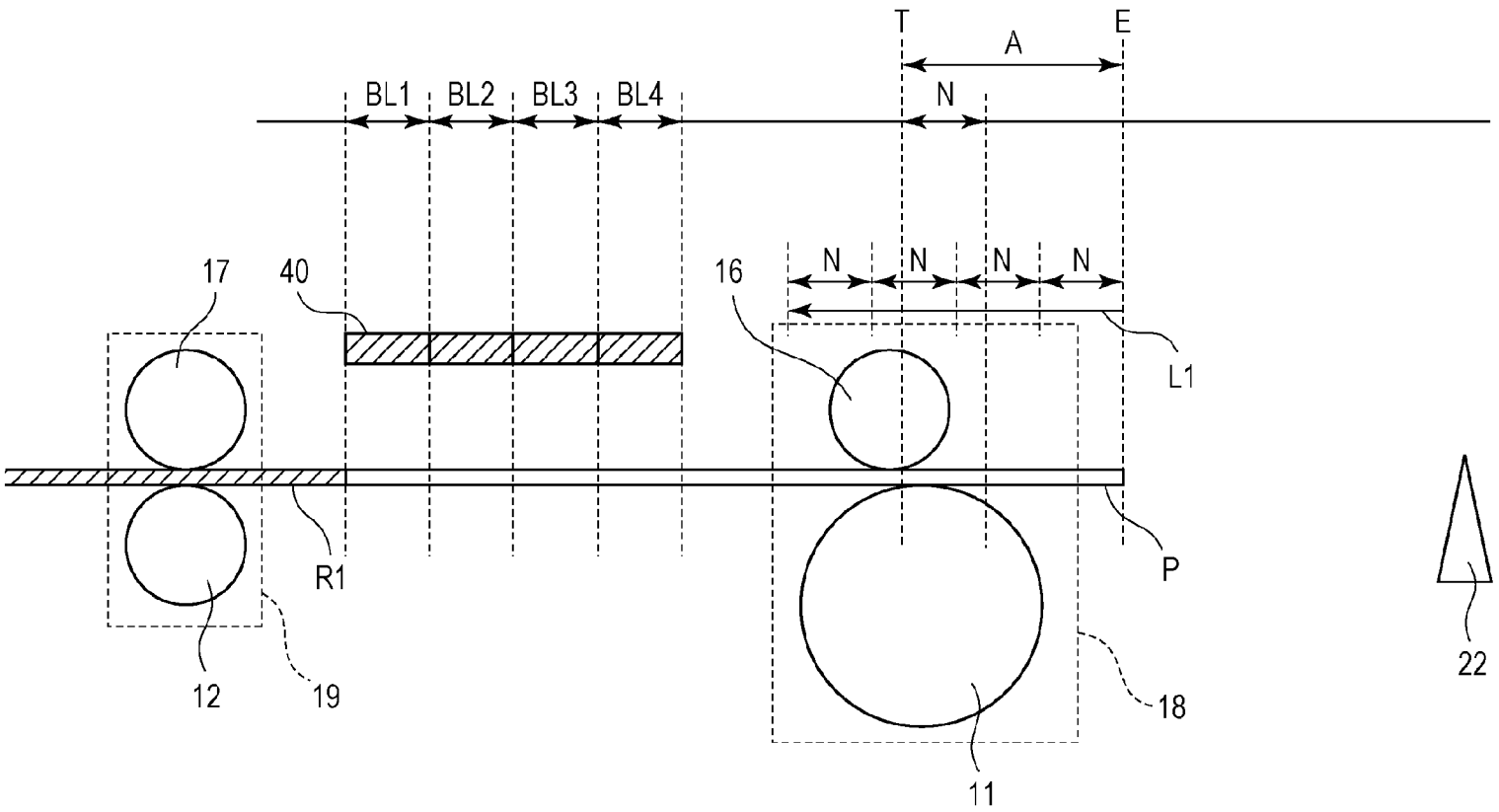
FIG. 5 is a diagram illustrating the layout of a discharge orifice array and recording medium, conveyance roller pair, and discharging roller pair.

FIG. 5 is a diagram illustrating the layout of the discharge orifice array 40 and recording medium P, the conveyance roller pair 18, and the discharging roller pair 19. R1 represents a recorded image formed by the prior image formation operation. The discharge orifice array 40 is divided into multiple, four in the present embodiment, discharge orifice blocks BL1 through BL4. The discharge orifice blocks BL1 through BL4 are discharge orifice groups in which multiple discharge orifices which discharge ink are arrayed in the conveyance direction of the recording medium P. The discharge orifice blocks BL1 through BL4 are used for the image formation operations onto the recording medium P. The length of each of the discharge orifice blocks BL1 through BL4 is a discharge orifice block length N. The length of the discharge orifice array 40 is N×4. Accordingly, the aforementioned conveyance amount L1 (first conveyance amount) is N×4.

A trailing edge position E is the position at the trailing edge of the recording medium P. A trailing edge distance A is a distance between the trailing edge position E to the nip position T. The trailing edge distance A is smaller than the conveyance amount L1, so if a conveyance operation of the conveyance amount L1 is performed, the trailing edge of the recording medium P passes the nip position T.

Figure 6:
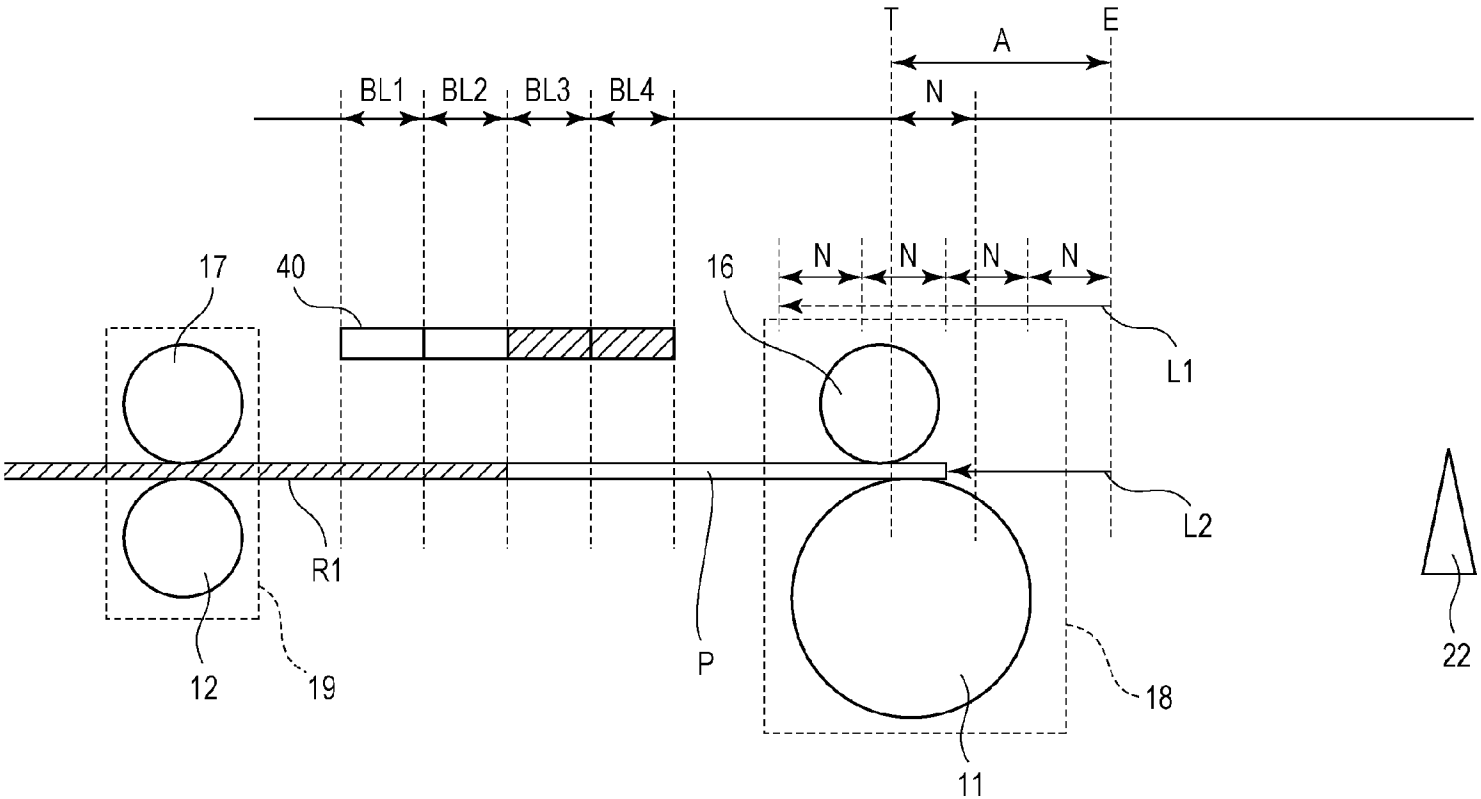
FIG. 6 is a diagram illustrating the layout of a discharge orifice array and recording medium, conveyance roller pair, and discharging roller pair.

FIG. 6 is a diagram illustrating the layout of the discharge orifice array 40 and recording medium P, the conveyance roller pair 18, and the discharging roller pair 19. As illustrated in FIG. 6, the recording medium P is conveyed by a conveyance amount L2 reduced by the length of the discharge orifice block length N×2. Accordingly, the trailing edge of the recording medium P does not pass the nip position T, and stops short of the discharge orifice block length N at a position upstream of the nip position T in the conveyance direction, where the distance from the nip position T is a predetermined distance.

Performing the image formation operation at the discharge orifice block upstream in the conveyance direction by a length equivalent to the length of the discharge orifice block length N×2 subtracted from the conveyance amount L1 maintains the continuity of the image formed in the image formation operation. That is to say, the discharge orifice blocks BL1 and BL2 perform image formation operations, while the discharge orifice blocks BL3 and BL4 do not perform image formation operations.

Figure 7:
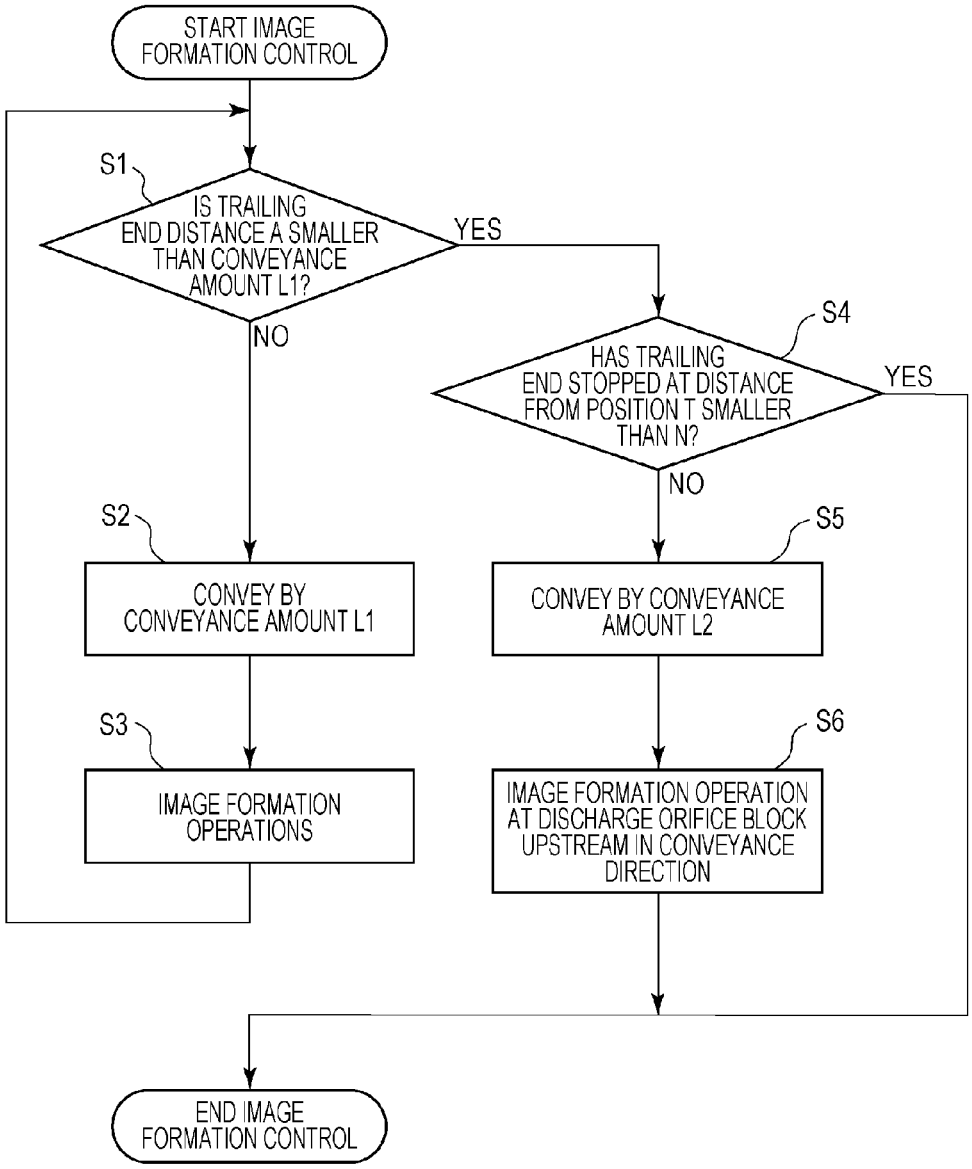
FIG. 7 is a flowchart illustrating image formation control according to a first embodiment.

FIG. 7 is a flowchart illustrating image formation control of the recording apparatus 1 according to the present embodiment. This image formation control is executed by the control unit B1. Upon the image formation control starting, in step S1 determination is made regarding whether or not the trailing edge distance A is smaller than the conveyance amount L1.

In a case where determination is made that the trailing edge distance A is not smaller than the conveyance amount L1, in step S2 the recording medium P is conveyed by the conveyance amount L1. After having conveyed the recording medium P by the conveyance amount L1, in step S3 the recording head 13 performs recording onto the recording medium P.

In a case where determination is made that the trailing edge distance A is smaller than the conveyance amount L1, in step S4 determination is made regarding whether or not the trailing edge of the recording medium P is on the upstream side of the nip position T in the conveyance direction, and the distance from the nip position T is smaller than the discharge orifice block length N.

In a case where determination is made that the trailing edge of the recording medium P is on the upstream side of the nip position T in the conveyance direction, and the trailing edge has not stopped at a position short of the discharge orifice block length N from the nip position T, in step S5 the recording medium P is conveyed by the conveyance amount L2.

After having conveyed the recording medium P by the conveyance amount L2, in step S6 image formation operation is performed by the discharge orifice blocks on the upstream side in the conveyance direction by an amount equivalent to N×2 subtracted from the conveyance amount L1, and the image formation control ends.

In a case where determination is made that the trailing edge of the recording medium P is on the upstream side of the nip position T in the conveyance direction, and the trailing edge has stopped at a position short of the discharge orifice block length N from the nip position T, in step S4, which is a positive determination, the image formation control ends.

Second Embodiment

A control method of the recording apparatus 1 in a case of performing conveyance operations by a conveyance amount of the discharge orifice block length N will be described in a second embodiment. Portions which are the same as those in the first embodiment will be omitted from description. In the present embodiment, recording operations are performed by repeating the image formation operations and the conveyance operations of conveying the recording medium P by the discharge orifice block length N. The present embodiment performs multi-pass recording where image formation operations are performed multiple main scans as to the same region to form images.

Figure 8:
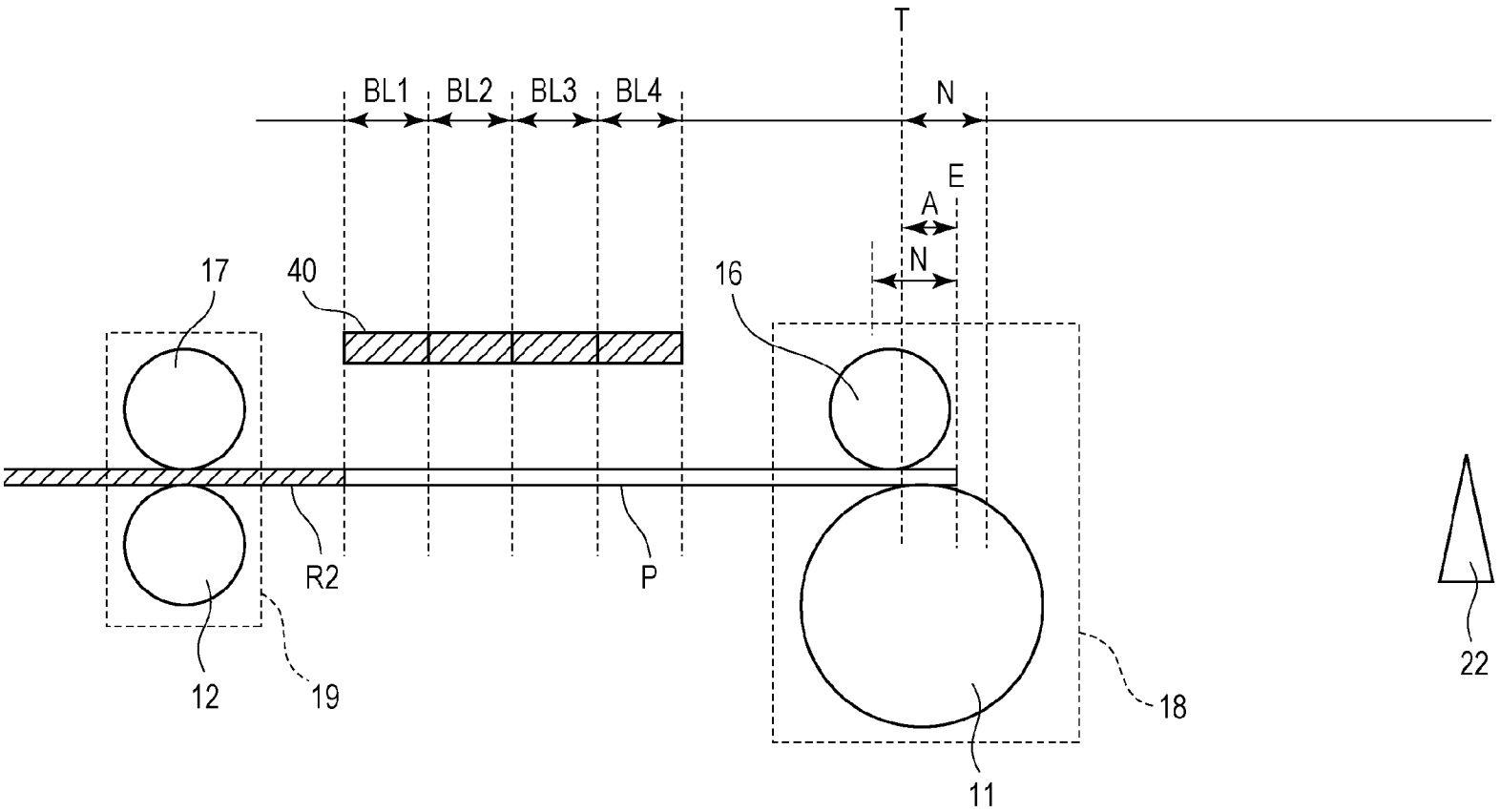
FIG. 8 is a diagram illustrating the layout of a discharge orifice array and recording medium, conveyance roller pair, and discharging roller pair.

FIG. 8 is a diagram illustrating the layout of the discharge orifice array 40 and recording medium P, the conveyance roller pair 18, and the discharging roller pair 19. In the present embodiment, an image is formed by performing image forming operations involving four main scans at the same region. Reference symbol R2 represents a recorded image of which image formation has been completed by four image formation operations. Image formation operations are performed by discharging ink onto the recording medium P from the discharge orifice blocks BL1 through BL4. The image formation operations thus complete formation of an image on the recording medium P facing the discharge orifice block BL4.

The trailing edge of the recording medium P has stopped upstream of the nip position T in the conveyance direction, with the distance from the nip position T short of the discharge orifice block length N. The trailing edge distance A is smaller than the conveyance amount N, so if a conveyance operation of the conveyance amount N is performed, the trailing edge of the recording medium P passes the nip position T. Accordingly, conveying operations following the image formation operations by the discharge orifice blocks BL1 through BL4 are not performed.

Figure 9:
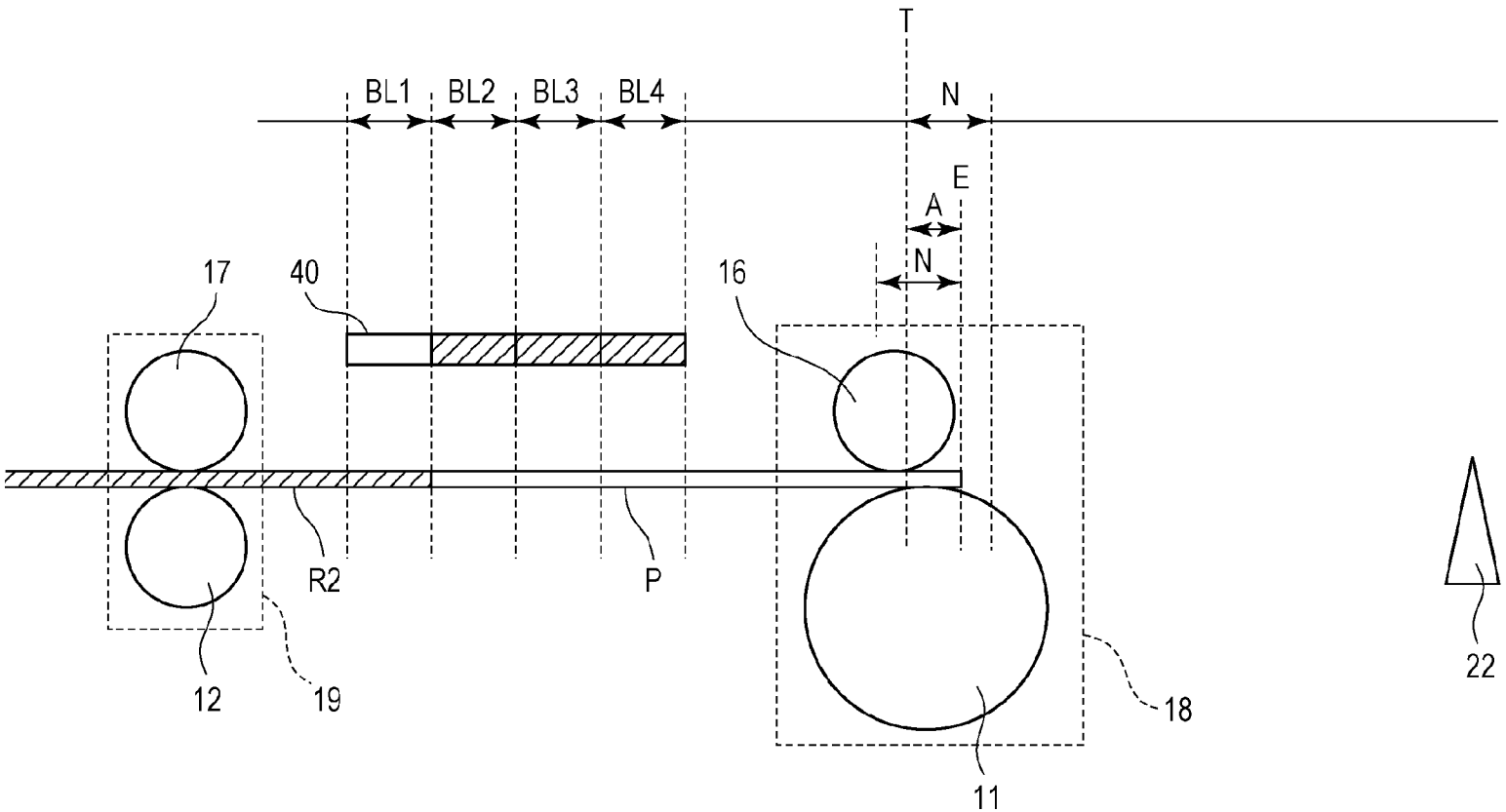
FIG. 9 is a diagram illustrating the layout of a discharge orifice array and recording medium, conveyance roller pair, and discharging roller pair.

FIG. 9 is a diagram illustrating the layout of the discharge orifice array 40 and recording medium P, the conveyance roller pair 18, and the discharging roller pair 19. FIG. 9 illustrates a state after the image formation operations in FIG. 8.

Here, image formation operations are performed by discharge orifice blocks on the upstream side in the conveyance direction, but an amount equivalent to the conveyance amount N by which the recording medium P was not conveyed after the image formation operations in FIG. 8. That is to say, image formation operations are performed by the discharge orifice blocks BL1 through BL3. After the image formation operations, the image formation operations by the discharge orifice blocks BL1 and BL2, and image formation operations by the discharge orifice block BL1, are performed in order, thereby completing formation of the image on the recording medium P facing the discharge orifice array 40.

Figure 10:
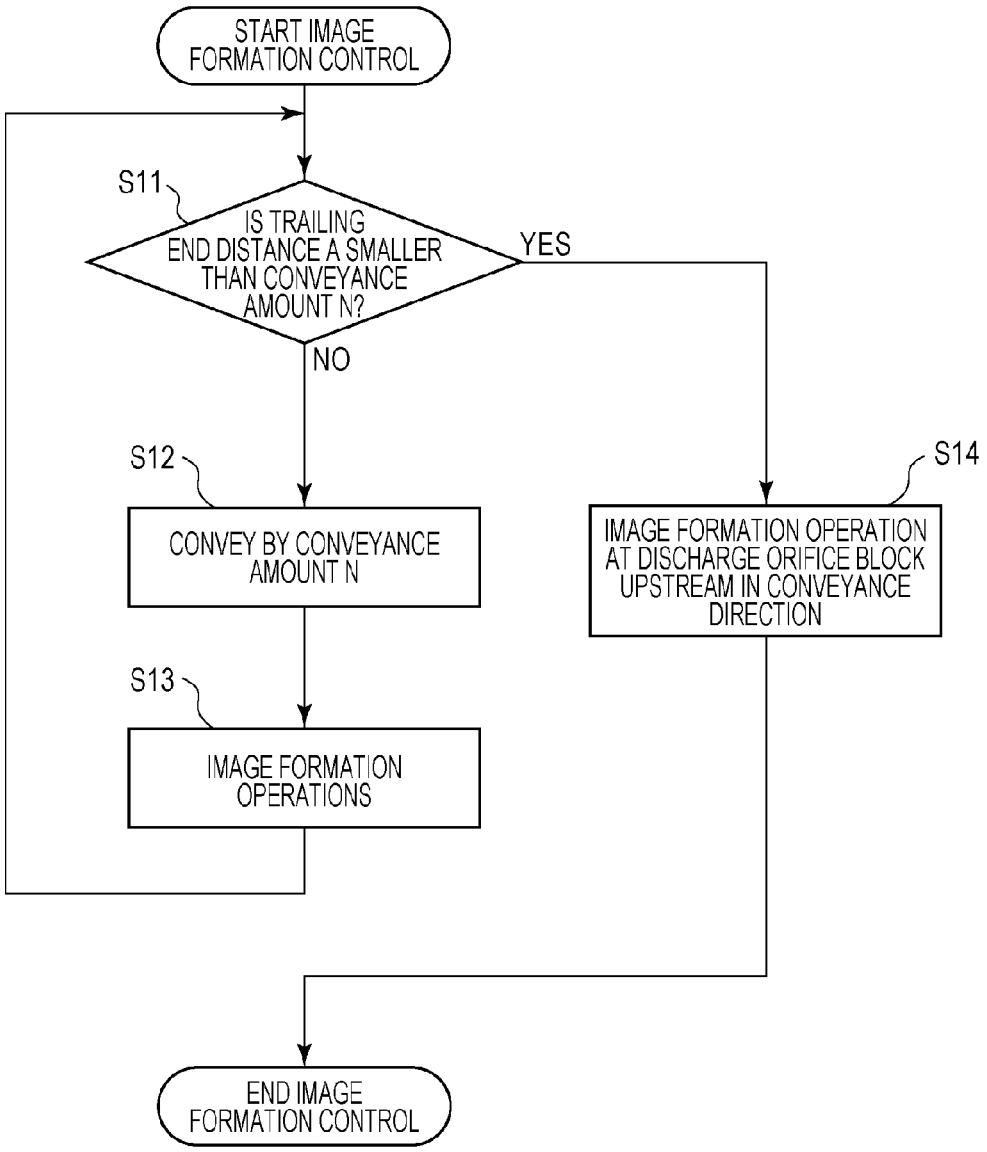
FIG. 10 is a flowchart illustrating image formation control according to a second embodiment.

FIG. 10 is a flowchart illustrating image formation control of the recording apparatus 1 according to the present embodiment. This image formation control is executed by the control unit B1. Upon the image formation control starting, in step S11 determination is made regarding whether or not the trailing edge distance A is smaller than the conveyance amount N.

In a case where determination is made that the trailing edge distance A is not smaller than the conveyance amount N, in step S12 the recording medium P is conveyed by the conveyance amount N. After having conveyed the recording medium P by the conveyance amount N, in step S13 the recording head 13 performs recording onto the recording medium P.

In a case where determination is made that the trailing edge distance A is smaller than the conveyance amount N, conveyance operations are not performed. In step S14, image formation operations are performed by the discharge orifice blocks at the upstream side in the conveyance direction by an amount equivalent to the conveyance amount N by which the recording medium P was not conveyed. After image formation operations are performed in step S14, the image formation control ends.

Other Embodiments

While the discharge orifice array 40 has been described as being divided into four in the first and second embodiments, the discharge orifice array 40 may be divided into other numbers, such as into six or eight, for example.

The paper end sensor 22 is not restricted to being installed at the upstream side of the conveyance roller 11 in the conveying direction. For example, the paper end sensor 22 may be installed at the downstream side of the conveyance roller 11 in the conveying direction. In this case, the trailing edge of the recording medium P is detected from detection position information of the leading edge of the recording medium P and information of the size of the recording medium P that has been stored beforehand, and so forth.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-150362, filed Jul. 19, 2013, which is hereby incorporated by reference wherein in its entirety.

What is claimed is:

1. A recording apparatus comprising:

a recording unit configured to record onto a recording medium;

a conveyance roller pair disposed on the upstream side of the recording unit in a conveyance direction of the recording medium;

a detecting unit configured to detect a trailing edge of the recording medium; and a control unit configured to perform recording on the recording medium by repeatedly performing a conveying operation of the conveyance roller pair conveying the recording medium by a first conveyance amount and an image formation operation of the recording unit forming an image on the recording medium, where the image formation operation is forbidden by the control unit once the trailing edge of the recording medium has passed the conveyance roller pair, wherein, in a case where determination is made by the detecting unit that a distance from the trailing edge of the recording medium to the conveyance roller pair is smaller than the first conveyance amount, the control unit effects control such that the conveyance roller pair conveys the recording medium by a second conveyance amount which is smaller than the first conveyance amount, so that the trailing edge of the recording medium is on the upstream side of the conveyance roller pair in the conveyance direction and that the distance from the trailing edge of the recording medium to the conveyance roller pair is smaller than a predetermined distance.

2. The recording apparatus according to claim 1, wherein the recording unit includes a discharge orifice array where a plurality of discharge orifice groups, having a plurality of discharging orifices arrayed in the conveyance direction, are arrayed in the conveyance direction;

wherein the predetermined distance is the length of the discharge orifice groups.

3. The recording apparatus according to claim 2, wherein the control unit effects control such that a discharge orifice group used in the image formation operation after a conveyance operation of the second conveyance amount is a different discharge orifice group from the discharge orifice group used in the image formation operation after a conveyance operation of the first conveyance amount.

4. The recording apparatus according to claim 2, wherein the second conveyance amount is an integer multiple of the length of the discharge orifice group.

5. The recording apparatus according to claim 1, wherein, in a case where the detecting unit detects that the distance from the trailing edge of the recording medium to the conveyance roller pair is smaller than the predetermined distance, the control unit effects control such that a next image formation operation is performed without conveying the recording medium by the conveyance roller pair.

6. The recording apparatus according to claim 1, further comprising:

a discharging roller disposed on the downstream side from the recording unit in the conveyance direction.

7. The recording apparatus according to claim 6, further comprising:

a conveyance motor configured to drive the conveyance roller pair, wherein the discharging roller is driven by the conveyance motor.

8. The recording apparatus according to claim 7, wherein the distance that a circumference of the conveyance roller pair travels when the conveyance motor is rotated by a predetermined amount is smaller than a distance that the circumference of the discharging roller travels.

9. The recording apparatus according to claim 8, wherein the force by which the conveyance roller pair holds the recording medium is greater than the force by which the discharging roller holds the recording medium.

10. A control method of a recording apparatus including a recording unit configured to record onto a recording medium, a conveyance roller pair disposed on the upstream side of the recording unit in a conveyance direction of the recording medium, and a detecting unit configured to detect a trailing edge of the recording medium, the method comprising:

a step of performing recording on the recording medium by repeatedly performing a conveying operation of the conveyance roller pair conveying the recording medium by a first conveyance amount and an image formation operation of the recording unit forming an image on the recording medium;

a step of, in a case where determination is made by the detecting unit that a distance from the trailing edge of the recording medium to the conveyance roller pair is smaller than the first conveyance amount, the conveyance roller pair conveying the recording medium by a second conveyance amount which is smaller than the first conveyance amount, so that the trailing edge of the recording medium is on the upstream side of the conveyance roller pair in the conveyance direction and that the distance from the trailing edge of the recording medium to the conveyance roller pair is smaller than a predetermined distance; and a step of forbidding the image formation operation once the trailing edge of the recording medium has passed the conveyance roller pair.

* * * * *